US006663026B2

(12) United States Patent
MacFarland

(10) Patent No.: US 6,663,026 B2
(45) Date of Patent: Dec. 16, 2003

(54) COMBINED FILTER AND ADJUSTER FOR A FUEL INJECTOR

(76) Inventor: Robert MacFarland, 958 Chiswick Cir., Newport News, VA (US) 23608

( * ) Notice: Subject to any disclaimer, the term of this patent is extended or adjusted under 35 U.S.C. 154(b) by 0 days.

(21) Appl. No.: 09/773,936

(22) Filed: Feb. 2, 2001

(65) Prior Publication Data

US 2001/0032888 A1 Oct. 25, 2001

Related U.S. Application Data

(60) Provisional application No. 60/179,678, filed on Feb. 2, 2000.

(51) Int. Cl.[7] ..... B05B 1/30; F02M 51/00

(52) U.S. Cl. ..... 239/585.1; 239/585.2; 239/585.3; 239/585.4; 239/585.5; 239/533.6; 239/575

(58) Field of Search ..... 239/585.1, 585.2, 239/585.3, 585.4, 585.5, 533.6, 575

(56) References Cited

U.S. PATENT DOCUMENTS

| | | | | |
|---|---|---|---|---|
| 4,590,911 A | | 5/1986 | Sciotti et al. | 123/468 |
| 5,335,863 A | | 8/1994 | DeGrace | 239/575 |
| 5,340,032 A | | 8/1994 | Stegmaier et al. | 239/575 |
| 5,516,424 A | | 5/1996 | Strohschein | 210/232 |
| 5,921,475 A | | 7/1999 | DeVriese et al. | 239/585.4 |
| 5,937,887 A | | 8/1999 | Baxter et al. | 137/15 |
| 5,979,866 A | * | 11/1999 | Baxter et al. | 239/585.1 |
| 6,328,232 B1 | * | 12/2001 | Haltiner et al. | 239/533.2 |
| 6,499,668 B2 | * | 12/2002 | Dallmeyer et al. | 239/5 |
| 6,499,677 B2 | * | 12/2002 | Dallmeyer et al. | 239/575 |
| 6,502,770 B2 | * | 1/2003 | Dallmeyer et al. | 239/585.1 |
| 6,508,417 B2 | * | 1/2003 | Dallmeyer et al. | 239/585.1 |
| 2002/0084358 A1 | * | 7/2002 | Dallmeyer et al. | 239/585.1 |
| 2002/0139870 A1 | * | 10/2002 | Dallmeyer et al. | 239/585.1 |

FOREIGN PATENT DOCUMENTS

| | | | |
|---|---|---|---|
| DE | 197 24 075 | 12/1998 | |
| EP | 0 781 917 | 7/1997 | |
| EP | 1 219 815 | 7/2002 | |
| EP | 1 219 820 | 7/2002 | |
| FR | 2 432 612 | 2/1980 | F02D/3/00 |
| WO | WO 98/05861 | 2/1998 | |
| WO | WO 98/15733 | 4/1998 | |
| WO | WO 99/66196 | 12/1999 | |
| WO | WO 00/43666 | 7/2000 | |

* cited by examiner

*Primary Examiner*—Robin O. Evans

(57) ABSTRACT

A fuel injector for controlling fuel flow to an internal combustion engine and a method of setting dynamic calibration for the fuel injector. The fuel injector has a body, a seat, an armature assembly, a resilient member, and a member. The member extends parallel to the longitudinal axis between a first portion and a second portion. The first portion supports the resilient member and engages the body, and the second portion has a filter. The method can be achieved, in part, by providing the member extending between the first portion and the second portion, fixing the filter to the second portion, moving the member along the longitudinal axis with respect to the body; and engaging the first portion with respect to the body such that the first portion supports the resilient member in a predetermined dynamic state.

17 Claims, 2 Drawing Sheets

COMBINED FILTER AND ADJUSTER FOR A FUEL INJECTOR

CROSS-REFERENCE TO RELATED APPLICATION

This application claims the benefit of the earlier filing date of the U.S. Provisional Application No. 60/179,678, filed Feb. 2, 2000, the disclosure of which is incorporated by reference herein in its entirety.

BACKGROUND OF THE INVENTION

This invention relates to solenoid operated fuel injectors, which are used to control the injection of fuel into an internal combustion engine.

The dynamic operating characteristics of fuel injectors, i.e., movement of a closure member within a fuel injector, are believed to be set by several factors. One of these factors is believed to be calibrating the biasing force of a resilient element acting on the closure member, i.e., tending to bias the closure member to its closed position.

It is believed that a known fuel injector uses a spring to provide the biasing force. In particular, it is believed that a first end of the spring engages an armature fixed to the closure member and a second end of the spring engages a tube that is dedicated solely to the dynamic calibration of the spring. It is believed that the spring is compressed by displacing the tube relative to the armature so as to at least partially set the dynamic calibration of the fuel injector. It is believed that the tube is subsequently staked into its position relative to the armature in order to maintain the desired calibration.

It is also believed that filtering the fluid passing through fuel injectors can minimize or even prevent contaminants from interfering with a seal between the closure member and a valve seat. It is believed that a known fuel injector includes a filter that is generally proximate to a fuel inlet of the fuel injector.

It is believed that a disadvantage of these known fuel injectors is that separate elements are used for the calibrating and the fuel filter, and these elements are handled in independent manufacturing processes. Typically, it is believed that the known fuel injectors are first dynamically calibrated using a first element, and then a separate filter element is subsequently added. The multiplicity of elements and manufacturing steps is costly, both in terms of money and time.

It is believed that there is a need to reduce the cost of manufacturing a fuel injector by eliminating the number of components and combining assembly operations.

SUMMARY OF THE INVENTION

The present invention provides a fuel injector for controlling fuel flow to an internal combustion engine. The fuel injector comprises a body, a seat, an armature assembly, a resilient member, and a member. The body extends along a longitudinal axis. The seat is secured to the body and defines an opening through which fuel flows. The armature assembly moves along the longitudinal axis with respect to the body between first and second positions. The first position is spaced from the seat such that fuel flow through the opening is permitted, and the second position contiguously engages the seat such that fuel flow is prevented. The resilient member biases the armature assembly toward the second position. And the member extends parallel to the longitudinal axis between a first portion and a second portion. The first portion supports the resilient member and engages the body, and the second portion has a filter.

The present invention further provides a method of setting dynamic calibration for a fuel injector. The fuel injector has a body extending along a longitudinal axis, a seat secured to the body, an armature assembly moving along the longitudinal axis with respect to the seat, and a resilient member biasing the armature assembly toward the seat. The method comprises providing a member extending between a first portion and a second portion, fixing a filter to the second portion, moving the member along the longitudinal axis with respect to the body; and engaging the first portion with respect to the body such that the first portion supports the resilient member in a predetermined dynamic state.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
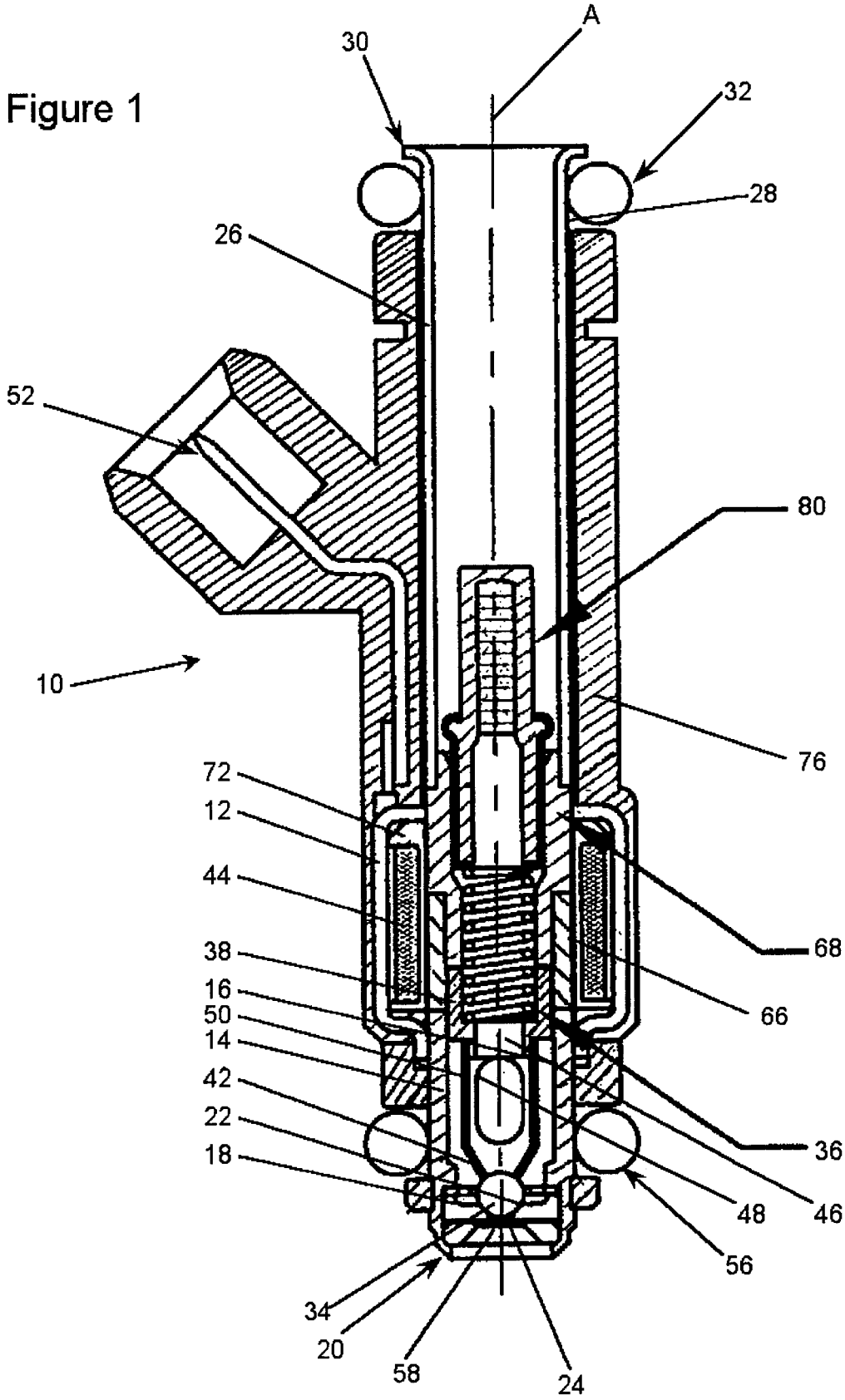
FIG. 1 is a cross-sectional view of a fuel injector assembly including a preferred embodiment of an adjuster member with an integral filter.

Referring to the figures, which depict a preferred embodiment, a solenoid actuated fuel injector 10, which can be of the so-called top feed type, supplies fuel to an internal combustion engine (not shown). The fuel injector 10 includes a housing 12 that extends along a longitudinal axis A and a valve body 14 fixed to the housing 12. The valve body 14 has a cylindrical sidewall 16 that is coaxial with and confronts a longitudinal axis A of the housing 12 and the valve body 14.

A valve seat 18 at one end 20 of the valve body 14 includes a seating surface 22 that can have a frustoconical or concave shape facing the interior of the valve body 14. The seating surface 22 includes a fuel outlet opening 24 that is centered on the axis A and is in fluid communication with a fuel tube 26 that receives pressurized fuel into the fuel injector 10. Fuel tube 26 includes a mounting end 28 having a retainer 30 for maintaining an O-ring 32, which is used to seal the mounting end 28 to a fuel rail (not shown).

Figure 2:
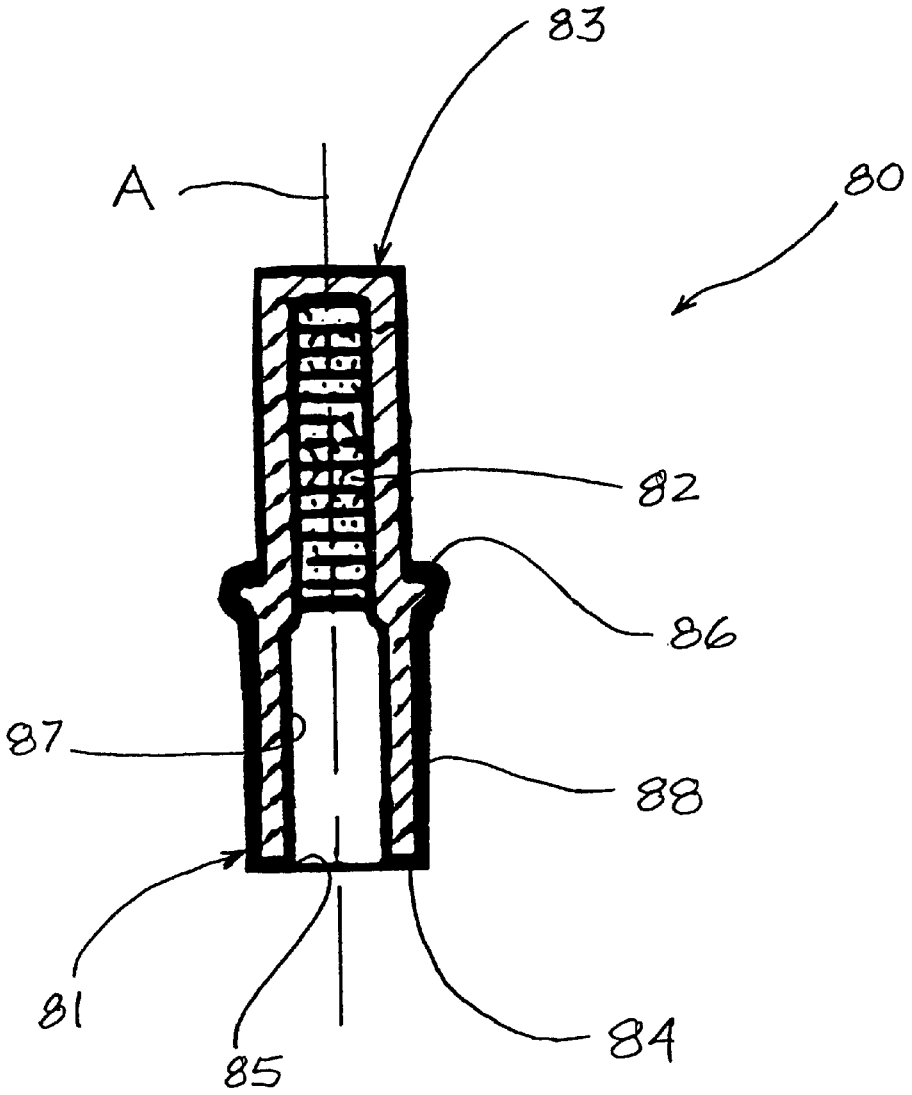
FIG. 2 is an enlarged cross-sectional view of the adjuster member shown in FIG. 1.

A closure member, e.g., a spherical valve ball 34, is moveable between a closed position, as shown in FIG. 2, and an open position (not shown). In the closed position, the ball 34 is urged against the seating surface 22 to close the outlet opening 24 against fuel flow. In the open position, the ball 34 is spaced from the seating surface 22 to allow fuel flow through the outlet opening 24. An armature 38 that is axially moveable in the valve body 14 can be fixed to the valve ball 34 at an end 42 proximate the seating surface 22. A resilient member 36 can engage the armature 38 for biasing the valve ball 34 toward the closed position.

A solenoid coil 44 is operable to draw the armature 38 away from the seating surface 22, thereby moving the valve ball 34 to the open position and allowing fuel to pass through the fuel outlet opening 24. De-energizing the solenoid coil 44 allows the resilient biasing member 36 to return the valve ball 34 to the closed position, thereby closing the outlet opening 24 against the passage of fuel.

The armature 38 includes an axially extending through-bore 46 providing a passage in fluid communication with the fuel tube 26. Through-bore 46 can also receive and center the valve ball 34. A fuel passage 48 extends from the through-bore 46 to an outer surface 50 of the armature 38 that is juxtaposed to the seating surface 22, allowing fuel to be communicated through the armature 38 to the valve ball 34.

With further reference to FIG. 1, an electrical connector 52 is provided for connecting the fuel injector 10 to an electrical power supply (not shown) in order to energize the armature 38. The fuel injector 10 includes a mounting end 54 for mounting the injector 10 in an intake manifold (not shown). An O-ring 56 can be used to seal the mounting end 54 in the intake manifold. An orifice disk 58 may be provided proximate the outlet opening 24 for controlling the fuel communicated through the outlet opening 24. The orifice disk 58 can be directly welded to the valve seat 18, or a back-up washer (not shown), which is fixed to the valve body 14, can be used to press the orifice disk 58 against the valve seat 18.

The injector 10 maybe made of two subassemblies that are separately assembled, then fastened together to form the injector 10. Accordingly, the injector 10 includes a valve group subassembly and a coil subassembly as hereinafter more fully described.

The valve group subassembly is constructed as follows. The valve seat 18 is loaded into the valve body 14, held in a desired position, and connected, e.g., by laser welding. Separately, the valve ball 34 is connected, e.g., by laser welding, to the armature 38. The armature 38 and valve ball 34 are then loaded into the valve body 14 including the valve seat 18.

A non-magnetic sleeve 66 is pressed onto one end of a pole piece 68, and the non-magnetic sleeve 66 and the pole piece 68 are welded together. The pole piece 68 is shown as an independent element that is connected, e.g., by laser welding, to the fuel tube 26. Alternatively, the lower end of the fuel tube 26 can define the pole piece 68, i.e., the pole piece 68 and fuel tube 26 can be formed as a single, homogenous body. The non-magnetic sleeve 66 is then pressed onto the valve body 14, and the non-magnetic sleeve 66 and valve body 14 are welded together to complete the assembly of the valve group subassembly. The welds can be formed by a variety of techniques including laser welding, induction welding, spin welding, and resistance welding.

The coil group subassembly is constructed as follows. A plastic bobbin 72 is molded with straight terminals. Wire for the coil 44 is wound around the plastic bobbin 72 and this bobbin assembly is placed into a metal can, which defines the housing 12. The terminals can then be bent to their proper arrangement, and an over-mold 76 covering the housing 12 and coil 44 can be formed to complete the assembly of the coil group subassembly.

Referring to FIG. 2, an adjuster or member 80 has a first portion 81, which is adapted to be staked to the pole piece 68, and a second portion 83 to which a filter 82 is connected. The second portion 83 and the filter 82 can be integrally molded as a plastic housing. The adjuster 80, which can be a metal tube, defines an annular recess that can receive a projection from the filter 82. A circumferentially outer surface 88 proximate the first portion 81 of the adjuster 80 engages the pole piece 68. According to a preferred embodiment, the first portion 81 contiguously engages the pole piece 68 and is held with respect thereto by a mechanical interlock such as a friction fit, adhesive, crimping, or any other equivalent means. The first portion 81 of the adjuster 80 also includes a generally axially facing surface 84 that supports, e.g., directly contacts, the resilient biasing member 36. The surface 84 can include a hole 85 through which fuel can pass after passing through the filter 82. The second portion 83 can also include a shoulder 86, which can be an exterior of a recess, that is adapted to be engaged by a pressing tool (not shown) for positioning the adjuster 80 with respect to the pole piece 68, and thereby compressing the spring 36 for the purpose of dynamically calibrating the fuel injector 10. The filter 82, which can be made of metal or plastic mesh or any other known equivalent material, can be integrally attached to the adjuster 80 during molding of the adjuster 80. The filter 82 extends along the longitudinal axis A away from the first portion 81 and comprises an interior surface generally confronting the longitudinal axis A and an exterior surface generally oppositely facing from the interior surface. The adjuster 80 is inserted into the pole piece 68, and subsequently fixed, e.g., staked, in the desired position.

The coil group subassembly is axially pressed over the valve group subassembly, and the two subassemblies can then be fastened together. Fastening can be by interference fits between the housing 12 and the valve body 14, between the housing 12 and the fuel tube 26, or between the fuel tube 26 and the over-mold 76. Welding can also be used for fastening, e.g., the housing 12 and the valve body 14 can also be welded together. The resilient biasing member 36 and adjuster 80 are loaded through the fuel tube 26 and the injector 10 is dynamically calibrated by adjusting the relative axial position of the adjuster 80, including integral filter 82, with respect to the pole piece 68. The adjuster 80 is then fixed in place with respect to the pole piece 68.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector for controlling fuel flow to an internal combustion engine, the fuel injector comprising:

a body extending along a longitudinal axis;

a fuel tube coupled to the body;

a seat secured to the body, the seat defining an opening through which fuel flows;

an armature assembly movable along the longitudinal axis with respect to the body, the armature assembly being movable between a first position spaced from the seat such that fuel flow through the opening is permitted and a second position contiguously engaging the seat such that fuel flow is prevented;

a pole piece coupled to the fuel tube so as to confront the armature assembly;

a resilient member biasing the armature assembly toward the second position;

a member extending parallel to the longitudinal axis between a first portion and a second portion, the first portion having circumferential surface of a generally constant diameter extending within the pole piece towards a terminal end of the first portion proximate the armature assembly, the circumferential surface friction fitted to the pole piece and the circumferential surface at the terminal end of the first portion being located entirely within the pole piece, the first portion supporting the resilient member, and the second portion having a filter molded to the second portion.

2. The fuel injector as claimed in claim 1, wherein the second portion comprises a surface that is pressed to move the member with respect to the body.

3. The fuel injector as claimed in claim 2, wherein the surface comprises an annular shoulder.

4. The fuel injector as claimed in claim 1, wherein the first portion comprises an aperture through which fluid flow passes.

5. The fuel injector as claimed in claim 1, wherein the filter extends along the longitudinal axis and comprises an interior surface generally confronting the longitudinal axis and an exterior surface generally oppositely facing from the interior surface.

6. The fuel injector as claimed in claim 5, wherein fuel flow passes through the filter from the exterior surface to the interior surface.

7. The fuel injector as claimed in claim 5, wherein the filter extends away from the first portion.

8. The fuel injector as claimed in claim 1, wherein the first portion comprises a fuel tight seal with respect to the body.

9. The fuel injector as claimed in claim 1, wherein the first portion comprises a metal tube and the second portion comprises a plastic housing.

10. The fuel injector as claimed in claim 9, wherein a first one of the metal tube and the plastic housing comprise a projection, a second one of the metal tube and the plastic housing comprise a recess, and the recess cooperatively receives the projection.

11. The fuel injector as claimed in claim 1, wherein the first portion comprises a surface contacting the resilient member.

12. The fuel injector as claimed in claim 1, wherein the first portion and the pole piece comprise respective cooperative surfaces.

13. The fuel injector as claimed in claim 12, wherein the cooperative surfaces mate by an interference fit.

14. A method of setting dynamic calibration for a fuel injector, the fuel injector having a body extending along a longitudinal axis, a fuel tube coupled to the body, a seat secured to the body, an armature assembly moving along the longitudinal axis with respect to the seat, a pole piece coupled to the fuel tube and a resilient member biasing the armature assembly toward the seat, the method comprising:

providing a member extending between a first portion and a second portion, the first portion having circumferential surface of a generally constant diameter extending within the pole piece towards a terminal end of the first portion proximate the armature assembly;

molding a filter to the second portion;

moving the member along the longitudinal axis with respect to the body; and frictionally fitting the first portion to the pole piece such that the circumferential surface at the terminal end of the first portion is located entirely within the pole piece and supports the resilient member in a predetermined dynamic state.

15. The method as claimed in claim 14, wherein the fixing the filter comprises extending the filter away from the first portion.

16. The method as claimed in claim 14, wherein the engaging comprises providing an interference fit between the first portion and the body.

17. The method as claimed in claim 14, wherein the engaging comprises sealing the first portion with respect to the body.

* * * * *

UNITED STATES PATENT AND TRADEMARK OFFICE

CERTIFICATE OF CORRECTION

PATENT NO. : 6,663,026 B2
DATED : December 16, 2003
INVENTOR(S) : Robert McFarland It is certified that error appears in the above-identified patent and that said Letters Patent is hereby corrected as shown below:

Title page,
Item [76], Inventor, "MacFarland," should read -- McFarland --; and
Insert the following item:
-- [73] Assignee: Siemens Automotive Corporation, Auburn Hills, MI --

Signed and Sealed this

Twentieth Day of April, 2004

JON W. DUDAS
*Acting Director of the United States Patent and Trademark Office*